United States Patent [19]

Rehberg et al.

[11] Patent Number: 4,749,599

[45] Date of Patent: Jun. 7, 1988

[54] STRIPS OF SOFT METAL FOIL, IN PARTICULAR TINSEL

[75] Inventors: Alfred Rehberg, Eppstein; Heinrich Besserer, Konigstein, both of Fed. Rep. of Germany

[73] Assignee: Stanniolfabrik Eppstein GmbH & Co. KG, Eppstein, Fed. Rep. of Germany

[21] Appl. No.: 44,652

[22] Filed: May 1, 1987 (Under 37 CFR 1.47)

[30] Foreign Application Priority Data

Jan. 14, 1987 [DE] Fed. Rep. of Germany ..... 3700859

[51] Int. Cl.[4] ..... A47G 33/08

[52] U.S. Cl. ..... 428/7; D11/121; 428/457; 428/542.6

[58] Field of Search ..... 428/7, 105, 114, 457, 428/542.6; D11/121

[56] References Cited

U.S. PATENT DOCUMENTS

| | | | |
|---|---|---|---|
| 3,449,197 | 6/1969 | Molinaro | 428/7 |
| 3,480,502 | 11/1969 | Schrenk | 428/7 X |
| 4,071,391 | 1/1978 | Haberstroh et al. | 427/409 X |
| 4,297,945 | 11/1981 | Sano et al. | 430/281 X |

*Primary Examiner*—Henry F. Epstein

*Attorney, Agent, or Firm*—H. Gibner Lehmann; K. Gibner Lehmann

[57] ABSTRACT

An ornamental strip of soft metal, for use as a decorative article such as tinsel, constituted as a single-ply tin-based metal foil having an antimony content of from 1 to 5 percent, by weight, and having a thickness of between 10 and 30 um. Both of the opposite surfaces can have shiny surface configurations imparted thereto. Alternately, one face can have a shiny surface configuration, with the opposite face being characterized by a dull, roughened configuration, as desired, for acheiving different ornamental appearances.

7 Claims, 1 Drawing Sheet

STRIPS OF SOFT METAL FOIL, IN PARTICULAR TINSEL

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to strips of soft metal foil, in particular ornamental strips having a length between 30 and 80 cm. and a width of from 1 to 5 mm. In particular the invention involves the production of strips intended for use as tinsel, for ornamental decoration of Christmas trees or other objects.

2. Description of the Related Art Including Information Disclosed Under 37 CFR ∫∫ 1.97–1.99

It is known to produce ornamental tinsel strips of a type having a shiny, silvery surface, from pure tin foil, or from a lead foil or an aluminum foil having on both sides a tin coating or plating.

In the case of pure tin, the material cost is considered relatively high. In addition, the manufacture of foil constituted of pure tin has a distinct drawback in that the foil does not have sufficient tear strength to withstand manual application of the foil to a Christmas tree, for example. Also, such pure tin strips do not produce the desired "hanging" or "draped" effect or appearance. Instead, they tend to wrinkle and become entangled with one another.

Strips constituted of aluminum foil, which are less expensive and have recently won preference as compared to those of tin, often do not provide the desired, pleasing appearance when suspended, because the aluminum strips are generally too stiff. Since the density of aluminum is considerably less than that of tin, the smooth, drooping characteristic of tin strips is lacking in their aluminum counterparts.

Moreover, strips constituted of aluminum tended to be flimsy, and susceptible to sudden movements or dislodgement from the tree branches, as for example, when experiencing even small drafts arising as from a door being opened or a person walking by.

In addition to tinsel constituted of tin or aluminum, lead foils have been produced, provided on both sides with a 2% tin coating. The more widely used tinsel at present consists of such tin-coated lead strips of approximately 25 um. thickness. Such lead strips, when suspended from a branch, provide the desired appearance. In view of their relatively large thickness, they possess good resistance against tearing or breakage. However, due to its toxicity, lead is considered undesirable for use in the home, especially where multiple strips characterized by a large total surface area are employed. Under such circumstances, where the strips are used repeatedly, the tin coating eventually suffers abrasion, and the underlying lead surface thus becomes exposed.

SUMMARY OF THE INVENTION

The above disadvantages and drawbacks of prior decorative strips employed as tinsel or the like are obviated by the present invention which has for one object the provision of a novel and improved decorative strip which has the desired attractive appearance characteristic of tin-coated lead strips, but which completely avoids the toxicity problems associated therewith.

A related object of the invention is to provide an improved decorative strip as above set forth, which is economical to produce, thereby keeping the overall cost as low as possible.

Still another object of the invention is to provide an improved decorative strip as above characterized, wherein the tear strength is sufficient to withstand manual application of the strip to the branch of a Christmas tree or other object, with minimal damage to the strip resulting from inadvertent breakage.

Yet another object of the invention is to provide an improved ornamental strip of the kind indicated, wherein either both sides of the strip can be provided with a shiny highly-reflective surface, or alternately a single side provided with such surface, with the remaining side being provided with a relatively dull surface finish.

The above objects are accomplished by the provision of strips of soft metal foil, in particular ornamental strips having a length between 30 and 80 cm., and a width of between 1 and 5 mm., formed of a single-ply metal foil having an antimony content of 1 to 5 per cent by weight, and a thickness of from 10 um. to 30 um. Preferably the antimony content is 2.5 per cent, with the thickness of the foil being between 12 um. and 15 um. The remainder of the foil composition is preferably constituted of pure tin.

By rolling the foil in a single layer, it is possible to produce either strips with shiny smooth surfaces on both sides, or strips with one side having a shiny smooth surface and the other side having a dull finish. The latter strip is formed by superposing two un-rolled strips, and passing them between two pressure rollers. The surfaces engaged by the rollers have a shiny, reflective characteristic imparted to them, whereas the facing surfaces of the strips tend to be striated and generally of dull or roughened finish.

We have discovered surprisingly, that strips made of tin-antimony alloy foil with an antimony content between about 1 and 5 per cent weight, when rolled down to a thickness of from 12 to 15 um., still have a comparably good tear strength and, in particular, a good decorative effect that is comparable with that of tin-coated lead strips of about 25 um. thickness. While lead foil provided with a tin coating cannot generally be rolled to a thickness less than 25 um., we have found that metal foils of tin-antimony alloy with an antimony content between about 1 and 5 per cent can be easily rolled down to thicknesses of about 10 um.

In spite of the lesser thickness, foil strips of tin-antimony of the type noted above can be suspended in such a manner that they will hang substantially vertically, or straight down, as desired, to achieve the appearance of tinsel and similar decorative strips.

In a preferred embodiment, the strips consist of metal foil of tin-antimony alloy with 2.5 per cent antimony content, by weight, with the remainder being tin.

Within the scope of the invention, the metal foil strips can be rolled to produce a shiny smooth, reflective surface on both sides. This is accomplished by rolling the strip to its desired final thickness and calendered as a single foil.

In addition it is possible to roll the metal foil strips so as to achieve a shiny smooth surface on one side, and a dull or roughened surface on the other. This is accomplished by rolling the strips in pairs so that the two outer surfaces of the pair have a shiny surface imparted thereto by the smooth rollers, and the two facing surfaces of the foils are pressed against each other and achieve a dull, rough surface quality.

To achieve a particularly high tear strength of the metal foil strips, the strips may be cut with their longitudinal axes in alignment with rolling directions.

Other features and advantages will hereinafter appear.

DESCRIPTION OF THE PREFERRED EMBODIMENT

Figure 1:
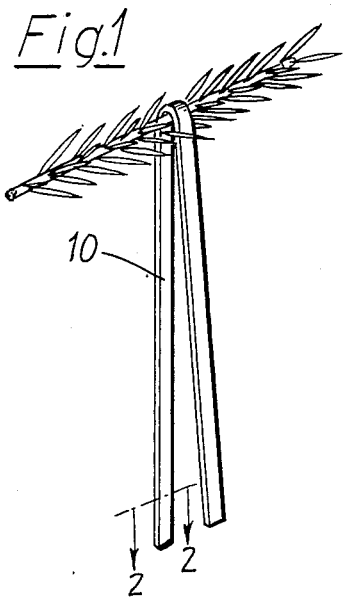
FIG. 1 is a perspective view of a decorative tin-antimony alloy foil strip, shown suspended from the branch of a Christmas tree.
Figure 2:
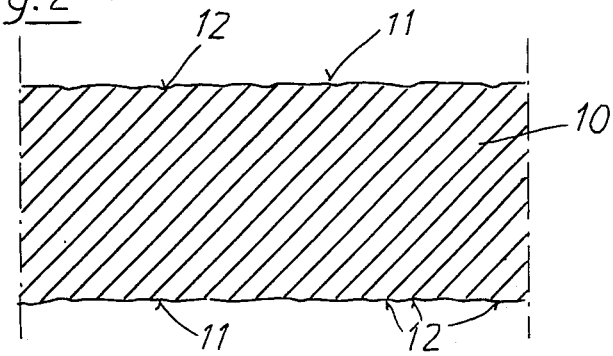
FIG. 2 is a section along line 2—2 of FIG. 1, with the surface of the strip being shown as smooth on both sides. This would yield a strip that reflected light from both surfaces. The view is greatly enlarged.
Figure 3:
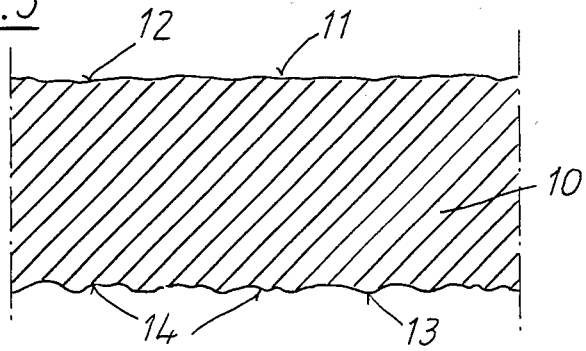
FIG. 3 is a section similar to that of FIG. 2, except with one surface of the strip being smooth and shiny and the other surface having a dull, roughened finish imparted thereto. Such a strip would be characterized by reflection mostly from the one smooth side.

FIG. 1 illustrates a tinsel strip 10 which is formed of a single-ply metal alloy foil, namely a tin-antimony alloy having an antimony content of roughly 2.5 per cent, by weight, with the remainder, 97.5, per cent being tin. The foil was rolled down to a thickness of from 12 to 15 um. In the Example of FIG. 2, the foil was rolled in a single layer, i.e. in the last pass with a calender mill (not shown) which caused only minor rolling imperfections or uneven areas 12 in the foil's surface. In the example of FIG. 3, two foils were superposed, one on top of the other, and the superposed foils rolled in the last pass of a calender mill (not shown) which again caused only minor rolling imperfections 12 on the one foil surface 11, whereas on the second foil surface 13, which had been in contact with the second, underlying foil, considerable roughening has occurred, due to pressing against the surface thereof. The small surface imperfections 12 visible in FIGS. 2 and 3 and caused by rolling are essentially minute rolling striae which are cut transversely in the illustration of FIGS. 2 and 3 because the section 2—2 is transverse to the foil strip 10, and the foil strip 10 is cut with its longitudinal axis aligned with the direction of rolling.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

List of reference symbols:

10—Metal foil strip
11—Rolled surface, shiny and smooth
12—Shallow, rolling imperfections
13—Pressed surface, dull and roughened
14—Deeper surface irregularities giving rise to roughness, and dull surface finish

What is claimed is:

1. An ornamental strip of soft metal, for use as tinsel, comprising a single-ply metal foil of a tin antimony alloy having an antimony content of from 1 to 5 percent, by weight, of the entire strip, and having a thickness between 10 and 30 um.

2. The invention as set forth in claim 1, wherein:
(a) the antimony content is substantially 2.5 per cent, by weight.

3. The invention as set forth in claim 1, wherein:
(a) the thickness of the foil is between 12 and 15 um.

4. The invention as set forth in claim 1, wherein:
(a) the opposite surfaces of the strip are shiny and smooth.

5. The invention as set forth in claim 1, wherein:
(a) one surface of the strip is shiny and smooth, and the other surface thereof is roughened, and dull.

6. The invention as set forth in claim 1, wherein:
(a) the strip is cut with its longitudinal axis in the direction in which it is rolled.

7. The invention as set forth in claim 1, wherein:
(a) the strip is cut with its longitudinal axis in a direction transverse to the direction in which it is rolled.

* * * * *